United States Patent [19]

Yoshida et al.

[11] Patent Number: 4,703,609

[45] Date of Patent: Nov. 3, 1987

[54] METHOD OF MANUFACTURING PRESSURIZED SEALED CONTAINERED FOOD

[75] Inventors: Eiichi Yoshida; Nobuyoshi Aoki; Toshimitsu Suzuki, all of Shimizu; Akira Hongo, Miki; Hideki Ueda, Nagoya; Issei Nakata, Shizuoka, all of Japan

[73] Assignees: Daiwa Can Company, Limited; Teisan Kabushiki Kaisha, both of Tokyo, Japan

[21] Appl. No.: 818,398

[22] Filed: Jan. 13, 1986

Related U.S. Application Data

[63] Continuation of Ser. No. 486,966, Apr. 20, 1983, abandoned.

[30] Foreign Application Priority Data

Apr. 22, 1982 [JP] Japan ..... 57-66318
Apr. 22, 1982 [JP] Japan ..... 57-66319

[51] Int. Cl.[4] ..... B65B 55/18

[52] U.S. Cl. ..... 53/431; 53/432; 53/474; 141/11; 141/339; 426/397

[58] Field of Search ..... 53/403, 431, 432, 467, 53/474, 510, 425; 141/11, 70, 392, 286, 339; 222/478, 481, 318; 426/392, 393, 397

[56] References Cited

U.S. PATENT DOCUMENTS

| | | | |
|---|---|---|---|
| 4,632 | 3/1884 | Caspersson | 222/478 |
| 12,183 | 5/1902 | Imray | 222/478 |
| 2,285,867 | 6/1942 | Minaker . | |
| 2,807,363 | 9/1957 | Hendrickson et al. | 141/11 X |
| 2,854,039 | 9/1958 | Boyd et al. | 53/510 X |
| 3,450,857 | 6/1969 | Webb . | |
| 3,477,192 | 11/1969 | Brown et al. | 53/432 |
| 3,903,938 | 9/1975 | Osborne | 222/318 X |
| 3,942,301 | 3/1976 | Domke | 53/510 X |
| 4,140,159 | 2/1979 | Domke | 141/70 X |

FOREIGN PATENT DOCUMENTS

| | | | |
|---|---|---|---|
| 0013132 | 7/1980 | European Pat. Off. | 53/425 |
| 2302059 | 7/1974 | Fed. Rep. of Germany . | |
| 2908574 | 9/1979 | Fed. Rep. of Germany . | |
| 32433 | 11/1965 | Japan . | |
| 161915 | 12/1981 | Japan . | |
| 1455652 | 11/1976 | United Kingdom | 53/431 |

*Primary Examiner*—Robert L. Spruill
*Assistant Examiner*—Steven P. Weihrouch
*Attorney, Agent, or Firm*—Wenderoth, Lind & Ponack

[57] ABSTRACT

A method of manufacturing pressurized, sealed containered food is disclosed, in which a predetermined quantity of low-temperature liquefied gas is charged through two or more low-temperature liquefied gas outlets into a succession of individual containers which have already a predetermined quantity of food including liquid content and are successively travelling upright with the top end open at a constant speed, and each container is subsequently sealed with a lid.

3 Claims, 6 Drawing Figures

METHOD OF MANUFACTURING PRESSURIZED SEALED CONTAINERED FOOD

This application is a continuation, of now abandoned application Ser. No. 486,966, filed Apr. 20, 1983.

BACKGROUND OF THE INVENTION

This invention relates to improvements in a method of manufacturing gas-sealed containered food by charging a predetermined quantity of low-temperature liquefied gas through a low-temperature liquefied gas outlet into individual containers, which are still open at the top and have already a predetermined quantity of food including liquid content while the containers are successively travelling at a constant speed and then sealing each container with a lid.

By the term "containered food" is meant canned food, bottled food or the like, and by the term "gas-sealed containered food" is meant, for example, a canned food containing food (e.g., solid food plus syrup) together with a low-temperature liquefied gas.

A method of charging a predetermined quantity of a low-temperature liquefied gas is sought in various industrial fields. Particularly, a method of charging an inert low-temperature liquefied gas is desired not for packing frothable liquid food containing $CO_2$ gas, e.g., beer, in containers but for packing non-frothable liquid food, (e.g., fruits in syrup; juice drinks; orange drinks containing orange sacs; and coffee drinks) by means of, for example, a hot filling process.

With a hot filled product in a can or the like, the can becomes depressed or convex when a negative pressure is generated as temperature of the contents falls after its sealing with a lid. Accordingly, the thickness of the can body is made sufficiently large so that it will not become depressed even when a negative pressure is generated. Recently, however in order to use cans having a thin body, it has been proposed to charge a predetermined quantity of an inert gas in the liquid state (which does not change the taste of the contents, such as liquid nitrogen) into the can containing a non-frothable drink filled while it is hot, so that pressure in the can is higher than atmospheric pressure after the can has been sealed and the content has been cooled down (at which time the liquefied gas is vaporized).

In the method of manufacturing gas-sealed containered food, in which an inert low-temperature liquefied gas (hereinafter referred to merely as low-temperature liquefied gas) is continuously charged into containers at high speed, there are problems.

In this method, a low-temperature liquefied gas is charged into containers while the containers are being moved at high speed. Therefore, the charged low-temperature liquefied gas is partly spattered to the outside of the containers and also partly vaporized to escape from the containers. Where the low-temperature liquefied gas is continuously released, it also falls into space between containers. With this method, therefore, considerable loss of low-temperature liquefied gas results. In addition, the quantity of low-temperature liquefied gas that is retained in individual containers fluctuates greatly.

To be more specific, the low-temperature liquefied gas has a very low boiling point. (For example, liquid nitrogen has a boiling point of approximately −196° C., and liquid argon has a boiling point of −186° C. at the atmospheric pressure.) While the low-temperature liquefied gas as released from an outlet flows toward the surface of the liquid in the container, the low-temperature liquefied gas is partly vaporized due to exposure to the surrounding atmosphere. It is also partly vaporized when it comes into contact with the liquid content. The resultant vaporized gas escapes to the outside of the container. Further, when the low-temperature liquefied gas strikes the surface of the content in the can, the low-temperature liquefied gas is partly spattered to the outside thereof by the striking impact. Still further, it is partly spattered by a blow-out action of sudden vaporization just when it reaches surface of the content. For the above reasons, a considerable amount of low-temperature liquefied gas is lost.

Moreover, the quantity of low-temperature liquefied gas (or evaporated gas) that remains in the container after the sealing thereof with a lid fluctuates greatly among individual containers.

Generally, volume of the low-temperature liquefied gas which is vaporized immediately after its release from the outlet and until it comes into contact with liquid content in the container is in proportion to the area of exposed surface of the released low-temperature liquefied gas.

From this standpoint, i.e., from the standpoint of reduction of the vaporization it has been considered to date that it is the best method to let a predetermined quantity of low-temperature liquefied gas be released from a single nozzle having a single outlet.

With this method of manufacture of gas-sealed containered food, however, a great deal of low-temperature liquefied gas is still lost, and quantity of the gas retained in the container fluctuates greatly among individual containers. Therefore, this method has not been commercially used. To overcome the above disadvantage, there has been proposed a method, in which the velocity at which the low-temperature liquefied gas reaches the content in the can, does not exceed 350 cm/sec. (as disclosed in Japanese Patent Laid-open Publication No. 161915/81).

According to this proposed method, the loss of low-temperature liquefied gas can be reduced to some extent. However, the loss is still considerable, and also the quantity of low-temperature liquefied gas (vaporized gas) retained in the container fluctuates greatly.

BRIEF SUMMARY OF THE INVENTION

An object of the invention is to provide a method of manufacturing gas-sealed containered food, which can reduce the fluctuations of the quantity of low-temperature liquefied gas retained in individual containers to a small range.

A second object of the invention is to provide a method of manufacturing gas-sealed containered food, which can reduce the loss of low-temperature liquefied gas released from an outlet and charged into containers.

Other objects of this invention will be understood from the detailed description of the preferred embodiment set forth below and the accompanying drawings.

According to the invention, there is provided a method of manufacturing gas-sealed containered food by charging low-temperature liquefied gas in a predetermined quantity continuously through an outlet for releasing said liquefied gas into each of several containers, said containers being successively travelling at a constant speed, each having a predetermined quantity of food including liquid content and being open at the top end, and subsequently sealing each of said containers with a lid, characterized in that said containers are charged with the predetermined quantity of said low-temperature liquefied gas released from two or more outlets.

According to the invention, there is also provided a method of manufacturing gas-sealed containered food by charging low-temperature liquefied gas in a predetermined quantity continuously through an outlet for releasing said liquefied gas into each of containers, said containers successively travelling at a constant speed, each having a predetermined quantity of food including liquid content and being open at the top end and subsequently sealing each of said containers with a lid, charactetized in that said containers are charged with said liquefied gas released from a plurality of outlets arranged in a row extending substantially parallel to the direction of travel of the containers.

Further, in the above second embodiment, the low-temperature liquefied gas may be released from a plurality of outlets arranged in a plurality of rows extending substantially parallel to the direction of travel of the containers.

Figure 1:
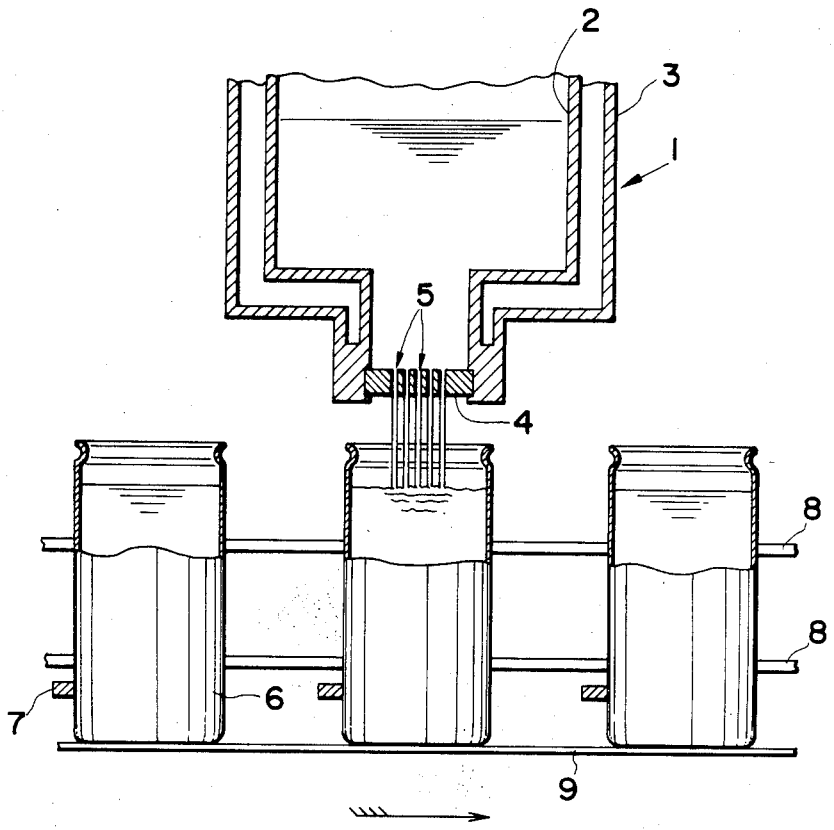
FIG. 1 is a fragmentary sectional view showing one embodiment of apparatus for carrying out the method according to the invention.

In the Figures, arrows indicate the direction of travel of containers.

DESCRIPTION OF THE PREFERRED EMBODIMENT

The inventors have conducted extensive experiments and found that when releasing low-temperature liquefied gas through the outlet of a nozzle into containers having liquid content while the containers are being moved, the spattering and rapid or drastic vaporization of the released low-temperature liquefied gas due to collision thereof with liquid surface of content increase in proportion to the intensity of collision.

The inventors have also found that the release of the low-temperature liquefied gas through a plurality of outlets will reduce the intensity of collision of the liquefied gas with the content liquid surface and suppress the spattering and drastic vaporization of the liquefied gas in a much more effective manner than the release through a single outlet, provided that the quantity of low-temperature liquefied gas to be released is the same.

As mentioned earlier, the vaporization of the liquefied gas released from the outlet until it reaches the content liquid surface in the can is proportional to the area of exposed surface of the liquefied gas.

That is, when a predetermined amount of the liquefied gas is charged into the can from a plurality of outlets and a single outlet respectively, the area of exposed surface of the liquefied gas released from a plurality of outlets is essentially larger than that from the single outlet, so that the plurality of outlets allow greater vaporization of the liquefied gas than the single outlet does. This means that in order to minimize the possible disadvantage of a method using a plurality of outlets as above the outlets must be set as close to the top of the container as possible. Desirably, this distance is set to be less than approximately 35 mm, or more preferably, less than 10 mm. By this setting of the outlets the intensity of collision noted earlier is reduced to such extent that velocity of the released liquefied gas suppresses the spattering and the like, whereby the possible disadvantage of a method of using a plurality of outlets can be successfully overcome.

The first aspect of the present invention is based on the above findings.

The inventors have further found as a result of experiments if the plurality of outlets are arranged in a row extending substantially parallel to the direction of travel of containers having the liquid content which are travelling with their top end open, the spattering and sudden vaporization of the low-temperature liquefied at the time of the collision thereof with the content liquid surface in the container can be reduced as compared with the case of other arrangements.

In addition, reduction of fluctuations of the pressure in the container after the sealing thereof can also be obtained.

The second aspect of the present invention is based on the above findings.

Reasons that the arrangement of the outlets in a row extending substantially parallel to the direction of progress of the successively travelling containers having liquid content with its top open can reduce the spattering, vaporization of the low-temperature liquefied gas and fluctuations of the inner pressure of the container after the sealing thereof, have not been clearly elucidated. However, conceivable reasons are as follows. With the arrangement noted above, the low-temperature liquefied gas, which is released from the respective outlets, can successively fall onto substantially the same position of the content liquid surface over a very short time interval.

To be more specific, the low-temperature liquefied gas released from the first outlet in the row, the outlet on the left hand end of the row in FIG. 1, in the direction of travel of the containers falls onto the content liquid surface at a position thereof. Then the liquefied gas released from the second outlet also falls onto substantially the same position as that of the above content liquid surface. Likewise, the liquefied gas released from the third, fourth and so forth outlets successively falls onto substantially the same position as above. The low-temperature liquefied gas released from the second outlet and thereafter thus falls on the liquefied gas which has already been charged into the container.

It is thought that this has an effect of reducing the vaporization of the low-temperature liquefied gas at the time of collision thereof with the content liquid surface and also reducing the spattering of the liquefied gas caused by the sudden vaporization of the liquefied gas.

Further, where the container to which the low-temperature liquefied gas is to be charged has a cylindrical shape like a can or has a circular or oval open top end, the outlets may be arranged along a line which is substantially parallel to the direction of travel of the containers and also substantially parallel to the diametrical line of the container. In this case, even if the low-temperature liquefied gas is released continuously, it substantially falls onto the diametrical line of the container, where the spaces between containers are naturally kept to a minimum. Thus, the quantity of the low-temperature liquefied gas falling into the spaces between adjacent containers can be reduced.

An embodiment of the invention will now be described with reference to the drawings.

A low-temperature liquefied gas storage tank 1 has a double-wall heat-insulating structure having inner and outer walls 2 and 3. A space between the walls 2 and 3 is evacuated.

The bottom of the storage tank 1 has a nozzle 4, through which a low-temperature liquefied gas is released down. The nozzle 4 has outlets 5. In the example shown in FIGS. 1 and 2, five outlets are provided in a row along a straight line.

Reference numeral 6 designates containers into which a liquid content has already been filled. In the examples, two-piece cans are shown. These containers 6 are supported at their body portion by respective pawl members 7 attached at a uniform interval to an endless chain (not shown) which travels is at a constant speed.

Reference numeral 8 designates a guide rail which restricts movement of the containers in directions perpendicular to the direction of their travel. Reference numeral 9 designates a table, on which the containers are slidably moved.

The individual outlets 5 are preferably arranged such that the center of the open top end of the containers 6 moves past these outlets 5. (For example, in case of containers having a circular open top end, the diametrical line through the container parallel with the direction of travel thereof is preferably vertically overlapped by the row of the outlets 5.)

The surface of the low-temperature liquefied gas in the storage tank 1 is subjected to an atmospheric pressure, and the level of the liquefied gas is controlled substantially constantly by a level control sensor and an electromagnetic valve (these being not shown). Thus the total amount of the low-temperature liquefied gas released from the outlets 5 per unit time is held substantially constant.

With this apparatus, the low-temperature liquefied gas can be released at a substantially constant rate (ml/sec.). Accordingly, a constant quantity of low-temperature liquefied gas can be charged into the individual containers if the containers with the top ends open are moved at a constant speed right under the outlets releasing the liquefied gas continuously.

As soon as the low-temperature liquefied gas is charged into each container, the container is immediately sealed by a well-known method and apparatus to prevent the charged liquefied gas from being dispersed to atmosphere by its vaporization and thus a constant gas pressure in the container is maintained.

EXAMPLE 1

Cans having a diameter of approximately 52.6 mm (or commonly termed 202 diameter), a height of approximately 132 mm and a capacity of 250 ml were used.

A juice drink containing 10% of orange juice was used as the liquid content. The juice drink is poured at a temperature of 95° C. into each can to leave a predetermined head space. The individual cans thus filled with the juice drink were immediately moved at a rate of 450 cans per minute (with adjacent cans spaced apart by approximately 5 cm) past a position right under liquid nitrogen releasing outlets.

Six liquid nitrogen releasing nozzles having different outlet arrangements A to F as listed in Table 1 below were used (the arrangement A being a contrast). The liquid nitrogen continuously released from the nozzle is charged into the moving cans.

Each can was then sealed immediately with an easy-open lid by the use of a sealing machine. Approximately 1.8 seconds was taken to start sealing of the can since it had just passed under the outlets.

The distance from the liquid surface of the liquid nitrogen storage tank to the bottom end of the outlet was controlled to approximately 110 mm. The distance from the bottom end of the outlet to the top end of each can moving under the outlet was set to 5 mm (the head space of each can being set to 12 mm). Under the conditions described above, the flow rate of liquid nitrogen at the points of release from outlets was measured. The results are listed in Table 1.

TABLE 1

| | A | B | C | D | E | F |
|---|---|---|---|---|---|---|
| Number of outlets | 1 | 2 | 3 | 5 | 8 | 12 |
| Outlet diameter (mm) | 1.7 | 1.2 | 1.0 | 0.8 | 0.6 | 0.5 |
| Flow rate (ml/sec) | 2.54 | 2.56 | 2.62 | 2.56 | 2.58 | 2.55 |

In the outlet arrangements B, C and D, the outlets are arranged in a row extending parallel to the direction of travel of cans. In the arrangement E, the outlets are arranged in two rows each having four outlets, and in the arrangement F outlets are arranged in three rows each having four outlets, extending parallel to the direction of travel of cans.

After the cans having the liquid content and liquid nitrogen therein were sealed, they were cooled down to room temperature. Then, the inner pressure in 25 cans tested by means of the outlet arrangements A to F were measured. The results are shown in Table 2.

TABLE 2

(n = 25)

| | A | B | C | D | E | F |
|---|---|---|---|---|---|---|
| Average inner pressure ($kg/cm^2$) | 1.21 | 1.31 | 1.47 | 1.69 | 1.65 | 1.68 |
| Fluctuation range ($kg/cm^2$) | 0.5~1.6 | 0.7~1.7 | 1.1~1.8 | 1.5~1.9 | 1.5~1.9 | 1.5~1.9 |
| Standard deviation ($kg/cm^2$) | 0.26 | 0.20 | 0.17 | 0.11 | 0.12 | 0.11 |

It will be readily appreciated from Table 2 that higher inner pressure can be obtained with two or more outlets than with a single outlet. This means that a greater quantity of liquid nitrogen remains in the can in case where two or more outlets are provided.

In addition, in the case of using two or more outlets, it is shown that the inner pressure fluctuation becomes smaller, which generally means more stable quality of the containered food.

This favorable result is appreciated to be attributable to the effect of the provision of a plurality of outlets as all outlet arrangements in the example are set to the same conditions in terms of amount and flow rate of released liquid nitrogen (the same level of liquid nitrogen under atomospheric pressure and the same distance from the outlets to the top end of the cans for all arrangements).

As has been shown, by means of provision of two or more low-temperature liquefied gas outlets a larger amount of the charged low-temperature liquefied gas is retained in the can (The retained liquefied gas is soon vaporized after the sealing of the can.) as compared with the provision of a single outlet in accordance with the prior art.

The desired amount of liquefied gas thus can be retained in the can with a lesser amount of the low-temperature liquefied gas to be released.

Increased quantity of the liquefied gas to be retained in the can or decreased loss of released liquefied gas caused by spattering, vaporization etc. means that it is possible to narrow the range of fluctuations of the amount of the liquefied gas to be retained in the sealed can, which gives an effect of reducing possibility of defects of canned food such as swelling of the can lid due to excess liquefied gas or depression of the can body due to insufficient liquefied gas sealed in the can.

The plural number of outlets provided in this invention may be n in a single nozzle or n/m in a plural number (m) of nozzles. It is further possible to provide different numbers of outlets in respective m nozzles. (Here m and n are respectively natural number which is more than 2.)

(Experiment)

Cans of 202 diameter having a capacity of 250 ml identical with the can in Example 1 were used. Water at 93° C. was poured into each can to leave a head space of approximately 13 mm. The individual cans were then conveyed immediately at a rate of 1,200 cans per minute under liquid nitrogen outlets and then each sealed with an easy-open lid. Approximately 0.5 seconds was taken to start sealing of the can since it has just passed under the outlets.

The liquid nitrogen releasing apparatus used in this experiment has two nozzles each having two rows of five outlets of 0.5 mm in diameter arranged along a line extending substantially parallel to the direction of travel of cans. The total releasing amount was set to 5.6 ml/sec.

The experiment was carried out by changing the distance between the bottom of the rows of outlets and the can top end to 1, 5, 10, 25, 35 and 50 mm respectively, and the average inner pressure and pressure fluctuations in the cans were measured.

The results are shown in Table 3 below.

TABLE 3

| Distance from outlet end to can top end (mm) | Average inner pressure ($Kg/cm^2$) | Fluctuation range of inner pressure ($Kg/cm^2$) | Standard deviation ($Kg\ cm^2$) |
|---|---|---|---|
| 1 | 1.55 | 1.4~1.7 | 0.09 |
| 5 | 1.53 | 1.3~1.8 | 0.11 |
| 10 | 1.47 | 1.2~1.7 | 0.14 |
| 25 | 1.43 | 1.1~1.6 | 0.15 |
| 35 | 1.41 | 1.0~1.7 | 0.18 |
| 50 | Average value was not calculated because paneling occured in two cans. | Average value was not calculated because the maximum was 1.6 while the minimum was minus. | — |

*Measurement was done for 15 cans for each distance.

It will be appreciated from the results of experiment that when the low-temperature liquefied gas is charged into a can already filled with a liquid content leaving an ordinary head space, it is necessary to set the distance from the bottom of the outlet to the can top end to 35 mm or below, preferably 10 mm or below in order to allow smaller loss of the low-temperature liquefied gas and fluctuations of the inner pressure in the can.

EXAMPLE 2

This example pertains to the second aspect of the invention mentioned above.

In this example, tin plate DI cans of approximately 52.6 mm in diameter (202 diameter), approximately 132 mm of height with 250 ml capacity were used.

Approximately 240 g (more specifically 240±1 g) of water at 90° C. was poured into the DI cans at a rate of 50 cans per minute. Liquid nitrogen was then charged into these cans while they were being moved at the same speed of 450 cans per minute under various arrangements of the liquid nitrogen nozzle units as shown below, and immediately thereafter the cans were sealed each with an easy-open lid using a sealing machine.

Conditions of Experiment

Quantity of liquid nitrogen charged—approximately 0.22 ml per can

Time taken from the completion of charging of liquid nitrogen to the start of sealing—1.8 seconds Distance from the bottom of the outlet to the top of the can flange (vertical distance)—approximately 5 mm Level of liquid nitrogen in the storage tank—approximately 140 mm Nozzle unit specifications (i.e., number and diameter of outlets, outlet pitch (center-to-center distance between adjacent outlets))—as listed in Table 4 (in the examples G, H, I and J, the outlets were 5 in number and 0.8 mm in diameter and spaced apart at a pitch of 2.5 mm, while in the example K the outlets were 12 in number, 0.52 mm in diameter and spaced apart at a pitch of 2.02 mm.)

In the nozzle unit G the outlet row was arranged to substantially vertically overlap the diametrical line of the open can top parallel to the direction of travel of cans.

Result of Experiment

Table 4 shows the measurements of average inner pressure in the can, fluctuation range thereof and standard deviation.

It will appreciated from Table 4 that with the same number of outlets (examples G, H, I and J) the highest average inner pressure (1.82) in the cans and the smallest inner pressure fluctuation range (0.5 or the balance of max. 2.0 and min. 1.5) can be obtained by means of the outlet arrangement in a row parallel to the direction of travel of cans (example G).

The closer to a line parallel to the direction of travel of cans the row of outlets are arranged, the higher is the average inner pressure in the cans and the smaller is the inner pressure fluctuation range.

Since the total rate of release of liquid nitrogen was the same with all the nozzle units used, it is appreciated that the higher average inner pressure in the can means the lesser loss of liquid nitrogen released from the outlets.

One of the reasons for the lesser loss is thought to be attributable to the reduction of spattering and sudden vaporization of the liquid nitrogen released from the outlets at the time of the collision of the released liquefied gas with the surface of the content in the can. Another conceivable reason is that the released liquefied gas which falls into space between adjacent cans is decreased as the row of outlets runs closer to a line parallel to the direction of the travel of cans as the cans are cylindrical and the farther the row of outlets is set off the diametrical line of the open top end of the can parallel to the direction of travel of cans, the greater is the quantity of released liquefied gas directed to the outside of the can. Further, it will be appreciated from the comparison of the results in the examples K and G that lesser loss of liquid nitrogen and inner pressure fluctuation range can be obtained by reducing the diameter of each outlet and the rate of release per outlet while maintaining the same total release rate.

TABLE 4

Figure 6:
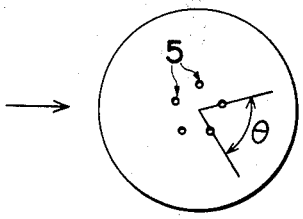
FIG. 6 is a bottom view showing a nozzle in an apparatus used for experiments carried out for the purpose of comparing the results obtained according to the invention.

| | Arrangement of outlets | Angle to the direction of travel of cans | Inner pressure in the cans ($Kg/cm^2$) Average | Fluctuation range | Standard deviation | Total rate of release of liquid nitrogen (ml/sec.) |
|---|---|---|---|---|---|---|
| G | 5 outlets arranged in a row parallel to the direction of travel of cans (see FIG. 2) | 0° | 1.82 | 1.5~2.0 | 0.12 | 2.60 |
| Comparison examples | | | | | | |
| H | 5 outlets arranged in a row at angle 45° to the direction of travel of cans | 45° | 1.54 | 1.1~1.8 | 0.15 | 2.60 |
| I | 5 outlets arranged in a row perpendicular to the direction of travel of cans | 90° | 1.46 | 1.0~1.7 | 0.17 | 2.60 |
| J | 5 outlets arranged on respective apices of a pentagon (see FIG. 6) | — | 1.49 | 1.0~1.7 | 0.19 | 2.60 |
| K | 12 outlets arranged in two rows each having 6 outlets parallel to the direction of travel of cans (see FIG. 3) | 0° | 1.91 | 1.7~2.1 | 0.09 | 2.60 |

*The inner pressure in 25 can was measured in each example.
*In the arrangement of the example J (FIG. 6), $\theta$ is 72°.

Figure 2:
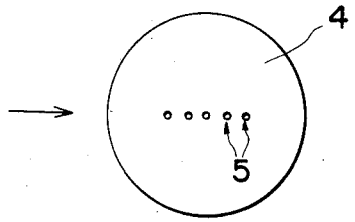
FIG. 2 is a bottom view showing a nozzle of the apparatus shown in FIG. 1.
Figure 3:
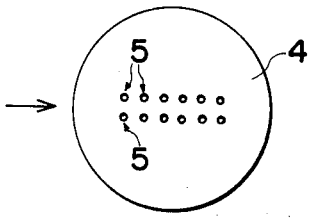
FIGS. 3 and 4 are bottom views showing other examples of the nozzle in other embodiments of apparatus for carrying out the method according to the invention.

(Outlets in FIG. 3 are shown in the same size as those in FIG. 2 for easy depiction.)

This is thought to be attributable to the reduction of the intensity of collision of the liquid nitrogen released from each outlet with the surface of the liquid content in the can, and hence the reduction of the loss or spattering of liquid nitrogen toward the outside of the can.

In the case of arrangement K, it is desirable from the standpoint of reducing the released liquid nitrogen which falls into space between the cans that the nozzle 4 is so positioned with respect to the cans 6 being conveyed that the liquid nitrogen released from the respective rows of outlets falls onto opposite sides of the diametrical line of the circle of the open top end of the cans 6.

Figure 4:
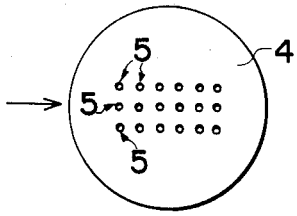

FIG. 4 is a bottom view of another nozzle which is used for carrying out the method according to the invention. This nozzle has a total of eighteen outlets 5 arranged in three rows each having six outlets and extending parallel to the direction of travel of containers as shown by the arrows. Outlets in FIG. 4 are shown in the same size as those in FIGS. 2 and 3 for easy depiction. When using this nozzle, it is desired from the standpoint of reducing the release of liquid nitrogen which falls into space between the containers 6 to the position the nozzle 4 with respect to the containers 6 being conveyed so that the liquid nitrogen released from the central row of outlets falls onto the diametrical line in the circle of the open top end of each container 6 parallel to the direction of travel of the containers. In this nozle, the diameter of each outlet is made smaller by a little less than 20% as compared with that of FIG. 3 while maintaining the same total release rate as in the example of FIG. 3, and therefore the intensity of collisition of the release from each outlet with the surface of the liquid content in the container and the spattering of the liquid nitrogen to the outside of the container is reduced.

Figure 5:
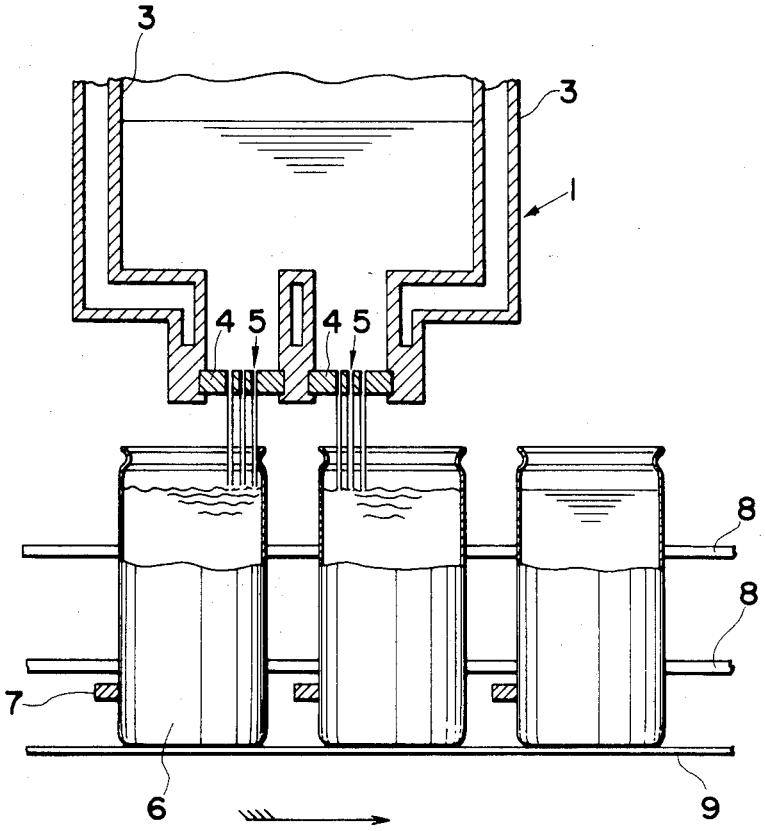
FIG. 5 is a fragmentary sectional view showing another embodiment of apparatus for carrying out the method according to the invention.

FIG. 5 is a fragmentary sectional view showing a different apparatus for carrying out the method according to the invention.

This apparatus is the same as that shown in FIG. 1 except for the bottom of the low-temperature liquefied gas storage tank 1 which now has two nozzles 4 provided in series in the direction of travel of containers. Each nozzle 4 has three outlets 5 arranged in a row parallel to the direction of travel of containers.

The purpose of this arrangement is to ensure that a predetermined quantity of liquid nitrogen is charged into each container 6 even when the speed of travel of the containers is changed.

Containers are ordinarily moved through a filling line at two different speeds, high speed and half speed depending on the condition of the line component machines and while the containers are being moved at high speed, the liquid nitrogen may be released from all six outlets 5 of the two nozzle 4.

On the other hand, while the containers are being moved at half speed, one of nozzles 4 may be shut off by means of a value (not shown) and the liquid nitrogen is allowed to be released only from the remaining three outlets 5 of the other nozzle 4. In either case, the same quantity of liquid nitrogen can be charged into each container 6.

While in this example of an apparatus according to this invention, each nozzle 4 has three outlets 5, it is more desirable to provide a greater number of outlets as mentioned above.

The nozzle described above has a plurality of outlets which are arranged along a perfectly straight line. However, these outlets may be arranged at such angles respectively that the liquefied gas released from each of the outlets falls onto a substantially straight line. This will be described in further detail in connection with, for instance, a nozzle having three outlets.

The three outlets may be so arranged that the two on the leading and trailing end of the nozzle, for example, are positioned on a line perfectly parallel to the direction of travel of containers and directed perfectly downwardly and the remaining outlet is positioned slightly off the above line but directed at such an angle that the low-temperature liquefied gas released from all these outlets falls onto a straight line on the surface of liquid contained in the container.

In this arrangement, the low-temperature liquefied gas released from the outlets other than the one on the leading end of the nozzle may fall on the same position of content liquid surface in the container as the liquefied gas from the outlet on the leading end does.

In the above example the two outlets positioned on a line parallel to the direction of the travel of the containers may be tilted toward the other outlet (which may also be tilted toward the above two outlets) so that the liquefied gas released from all three outlets falls on a substantially straight line on the surface of liquid contained in the container.

These arrangements can result in the same effect as the arrangement with which all the outlets are aligned.

In the method according to the invention, other liquefied gases than liquid nitrogen in the above embodiments, e.g., liquid argon, may be used as well. The container may be metal containers or plastic containers having a single-layer wall structure, a double-layer wall structure or a wall structure consisting of more than two layers or composite containers consisting of a variety of combinations of metal foils, paper sheets, plastic sheets, etc.

Further, after a low-temperature liquefied gas is charged into the container having content therein and before the time the container is sealed, the air remaining in the container is purged by the gas resulting from the vaporization of the liquefied gas.

Thus, an effect of preventing the deterioration of the containered liquid food or the like content during storage is attained. For this reason, the invention can be applicable not only to the hot filling process but also to the cold filling process to obtain high quality containered gas-sealed containered food.

What is claimed is:

1. In a method of manufacturing pressurized, nitrogen gas-sealed containered food including liquid, the internal pressure of the container after the sealing thereof being greater than the atmospheric pressure, by charging liquefied nitrogen in a predetermined quantity continuously through an outlet for releasing said liquefied nitrogen into each of said containers, said containers successively travelling at a constant speed under said outlet, each container having a predetermined quantity of food including liquid content and being open at the top end, said top end being circular, and subsequently feeding said containers to a sealing machine to seal each of said containers with a lid, said food including liquid content being relatively large with respect to said liquid nitrogen content, the improvement comprising the step of continuously releasing said liquefied nitrogen onto the content liquid surface from a plurality of outlets arranged in a row extending substantially parallel to the direction of travel of the containers and being above the diametrical line of said circular top end or proximate thereto, the distance from the bottom of the outlet to the can top end being set at 35 mm. or below.

2. The method of manufacturing pressurized, nitrogen gas-sealed containered food according to claim 1, comprising the step of continuously releasing said liquefied nitrogen from a plurality of outlets arranged in a plurality of rows extending substantially parallel to the direction of travel of the containers.

3. In a method of manufacturing pressurized, nitrogen gas-sealed containered food including liquid, the internal pressure of the container after the sealing thereof being greater than the atmospheric pressure, and liquefied nitrogen charged into each container being substantially constant in the amount before and after the change of speed of travel of the container, by charging liquefied nitrogen in a predetermined quantity continuously through an outlet for releasing said liquefied nitrogen into each of said containers, said containers successively travelling under said outlet, each having predetermined quantity of food including liquid content and being open at the top end, said top end being circular, and subsequently feeding said containers to a sealing machine to seal each of said containers with a lid, the improvement comprising the step of continuously releasing said liquefied nitrogen onto the content liquid surface from a plurality of outlets arranged in a row extending substantially parallel to the direction of travel of the containers and being above diametrical line of said circular top end or proximate thereto, the distance from the bottom of the outlet to the can top end being set at 35 mm. or below, said liquefied nitrogen being released continuously from some of the plurality of outlets constituting said row when the speed of travel of the container is a first relatively low speed, and from all of said outlets when said speed is a second speed higher than the first speed.

* * * * *